US006640875B1

(12) United States Patent
Kobayashi et al.

(10) Patent No.: US 6,640,875 B1
(45) **Date of Patent: *Nov. 4, 2003**

(54) INJECTION MOLDING METHOD OF METAL MATERIAL

(75) Inventors: Takahiro Kobayashi, Nagano-ken (JP); Mamoru Miyagawa, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/672,366

(22) Filed: Sep. 28, 2000

(30) Foreign Application Priority Data

Sep. 30, 1999 (JP) ..... 11-279351

(51) Int. Cl.[7] ..... B22D 17/00
(52) U.S. Cl. ..... 164/113; 164/900
(58) Field of Search ..... 164/113, 900, 164/312

(56) References Cited

U.S. PATENT DOCUMENTS 5,501,266 A * 3/1996 Wang et al. ..... 164/113

5,983,976 A * 11/1999 Kono ..... 164/113

* cited by examiner

*Primary Examiner*—M. Alexandra Elve
*Assistant Examiner*—Len Tran
(74) *Attorney, Agent, or Firm*—Weingarten, Schurgin, Gagnebin & Lebovici LLP

(57) ABSTRACT

An injection molding method of a metal material in a liquid phase state, by which the material can be transferred, metered, and deaerated smoothly by operating the movement and rotation of the screw. After injection, retraction resistance made of the metal material that went into a clearance between the heating cylinder and screw flights is removed in advance by rotating the screw for a set number of times at a forward position. Then, the metal material in the liquid phase state is accumulated in a front chamber by forcing the screw to retract for a set distance, and applying a back pressure to the screw rotating at a retraction position, thereby starting transfer of the metal material. Subsequently, the rotation of the screw is stopped, whereupon the accumulation is completed. Then, the accumulated metal material is pressed by moving the screw forward. Injection is effected only when a material pressure reaches a set pressure within a preset forward distance of the screw, whereupon metering is assumed to have been completed.

2 Claims, 2 Drawing Sheets

INJECTION MOLDING METHOD OF METAL MATERIAL

BACKGROUND OF THE INVENTION

1. Field of the Invention

The present invention relates to an injection molding method of metal material, and more particularly to an injection molding method of a metal material, by which nonferrous metal having a low melting point, such as zinc, magnesium, or alloy thereof, is completely melted to allow injection molding in a liquid phase state.

2. Detailed Description of the Prior Art

Attempts have been made to completely melt nonferrous metal having a low melting point so as to allow injection molding in a liquid phase state. Like in the case of injection molding of a plastic material, the molding method thereof adopts a heating cylinder having inside an injecting screw, which is allowed to rotate and move along the axial direction. A granular metal material supplied from the rear portion of the heating cylinder is heated and melted completely while being transferred toward the head of the heating cylinder by means of rotation of the screw, and after a quantity of the metal material in the liquid phase state is metered in the front chamber of the heating cylinder, the metal material is injected into a mold through the nozzle attached to the tip of the heating cylinder by moving the screw forward.

A problem occurring in case of adopting the foregoing injection molding for the metal material is that the material is neither transferred readily nor metered in a stable manner by means of rotation of the screw.

A molten plastic material has a high viscosity, and transfer of the molten plastic material by means of rotation of the screw is allowed mainly because a friction coefficient at the interface of the molten plastic material and the screw is smaller than a friction coefficient at the interface of the molten plastic material and the inner wall of the heating cylinder, and therefore, a difference in friction coefficient is produced between the two interfaces.

In contrast, the metal material, when melted completely to the liquid phase state, has such a low viscosity compared with the plastic material that a difference in friction coefficient is hardly produced between the above two interfaces. Hence, a transfer force such as the one produced with the molten plastic material by means of rotation of the screw is not readily produced.

However, a transfer force is produced with the metal material when it is in a solid state and in a high viscous region where the metal material is in a semi-molten state during the melting process. Thus, the metal material can be transferred by means of rotation of the screw up to that region. Nevertheless, as the metal material is further melted, the viscosity drops with increasing ratio of the liquid phase, and the transfer force produced by the screw groove between the screw flights decreases, thereby making it difficult to supply the molten metal material in a stable manner to the front chamber of the heating cylinder by means of rotation of the screw.

Because the molten plastic material has a high viscosity, it is stored in the front chamber of the heating cylinder by means of rotation of the screw, while at the same time, a material pressure that pushes the screw backward is produced as a reaction. By controlling the screw retraction caused by the material pressure, air bubbles or the like contained in the molten material can be deaerated, and further, the material can be metered in a stable manner.

However, the metal material in the low-viscous liquid phase state cannot produce a pressure high enough to push the screw backward. Thus, the screw retraction by the material pressure hardly occurs, and if the metal material is stored in the front chamber by means of rotation of the screw alone, a quantity thereof undesirably varies. This poses a problem that neither can steady (stable) metering nor satisfactory deaeration be readily conducted.

In addition, the metal material in the liquid phase state has a low viscosity and fluidity. For this reason, when it is allowed to stand by stopping rotation of the screw, the metal material in the liquid phase state goes into a clearance formed between the screw flights and heating cylinder, and heat is transferred to the screw when the metal material is brought into physical contact with the screw flights, thereby causing the metal material to be solidified. The resulting solid serves as resistance for the screw retraction, which may prevent a smooth operation of the screw.

SUMMARY OF THE INVENTION

The present invention is devised to solve the above problems raised with injection molding of a metal material in the liquid phase state, and therefore has an object to provide a novel injection molding method of a metal material, by which the metal material in the liquid phase state can be transferred, metered, and deaerated smoothly at all times by operating the movement and rotation of the screw.

In order to achieve the above and other objects, the present invention is an injection molding method of a metal material adapted to employ an injection apparatus comprising a heating cylinder provided with a nozzle at a tip thereof and a supply port at a rear portion thereof and having inside a screw, which is allowed to rotate and move along an axial direction, for injecting the metal material metered in a liquid phase state through the nozzle by moving the screw forward, and the method includes the following steps of: removing, after injection, retraction resistance made of the metal material having gone into a clearance between the heating cylinder and screw flights in advance by rotating the screw for a set number of times at a forward position; accumulating the metal material in the liquid phase state in a front chamber by forcing the screw to retract for a set distance, and applying a back pressure to the screw rotating at a retraction position, thereby starting transfer of the metal material; completing accumulation by stopping rotation of the screw; pressing the metal material accumulated by moving the screw forward; and effecting injection only when a material pressure reaches a set pressure within a preset forward distance of the screw, whereupon metering is assumed to have been completed.

The screw may include an injecting plunger at the tip, and the plunger has substantially a same diameter as a diameter of the front chamber formed in the heating cylinder at a top end portion by reducing a diameter thereof so as to be allowed to fit into the front chamber by moving forward and backward while securing a sliding clearance such that hardly causes a back flow of the metal material in the liquid phase state accumulated in the front chamber.

According to the present invention, the forced retraction of the screw is allowed smoothly by, after injection, rotating the screw at the forward position and removing in advance the resistance for the retraction of the screw made of the metal material having gone into the clearance between the heating cylinder and screw flights. Consequently, even if the metal material is in the low-viscous liquid phase state, the metal material can be transferred readily by the screw.

In addition, because the metal material in the liquid phase state can be stored primarily and the accumulation quantity of the metal material in the front chamber can be compensated by means of rotation of the screw, a shortage in the accumulation quantity before metering can be prevented. Further, deaeration in the front chamber can be conducted by moving the screw forward before injection. In addition, injection is effected only when it is confirmed that at least a predetermined quantity has been metered based on the forward distance and material pressure, injection molding of a product made of the metal material in a stable injection state can be performed.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
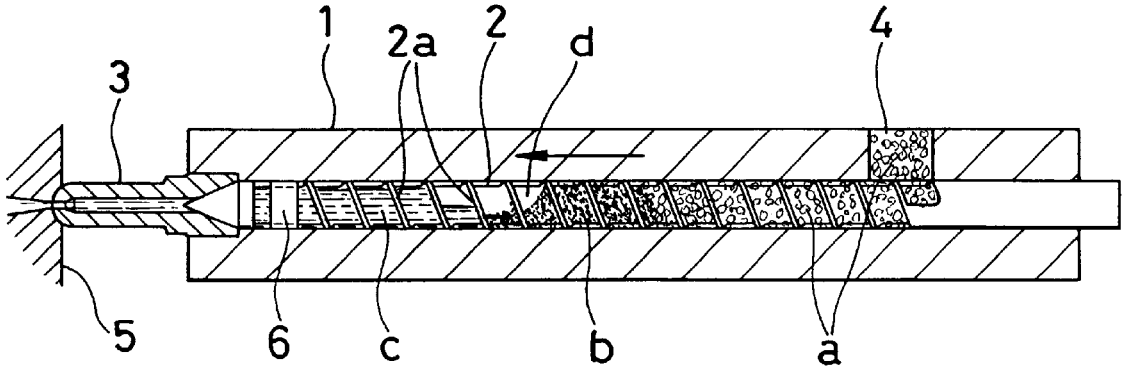
FIG. 1 is a schematic explanatory view showing an injection apparatus after injection, which is employed in an injection molding method of a metal material of the present invention.

The following description will describe the present invention in detail with reference to the accompanying drawings.

In the drawings, reference numeral 1 denotes a heating cylinder of an injection apparatus of a typical known structure, which is fabricated by attaching band heaters (not shown in the drawings) at regular intervals on the outer periphery of the cylinder, and an injecting screw 2 housed therein is allowed to rotate and move along the axial direction. The heating cylinder 1 also has a nozzle 3 at the tip thereof and a supply port 4 of a granular metal material at the rear portion thereof. Reference numeral 5 denotes a mold having nozzle touch with the tip of the nozzle 3.

The screw 2 is of a typical known type, and a back-flow preventing ring valve 6 is fitted into the outer circumference of the top end portion shaped in a cone in such a manner that it is allowed to move forward and backward. The screw 2 does not have a compressing section, and is formed in such a manner that flights are formed in spiral on the periphery of the axis portion having a constant diameter so that screw grooves at predetermined pitches are formed between the adjacent flights, by which the granular metal material supplied from the supply port 4 is transferred toward the head of the heating cylinder 1 by means of rotation of the screw 2.

FIG. 1 schematically shows a molten state of the metal material at the forward position of the screw 2 after injection. It should be appreciated that the metal material turns from a granular material a to a semi-molten material b and to a liquid phase material c from the rear to the head. At the upper portion of a region where the semi-molten material b turns to the liquid phase material c, a gaseous phase d is produced. Because the liquid phase material c has a low viscosity, the metal material goes into a clearance between the heating cylinder 1 and screw flights 2*a*. When brought into physical contact with the screw flights 2*a*, the metal material releases its heat to the screw 2 and resides in a solid phase state, there by serving as resistance for the retraction of the screw 2. In order to allow the screw 2 to retract smoothly, the metal material residing in the clearance is removed by rotating the screw 2 before the retraction of the screw 2.

Figure 2:
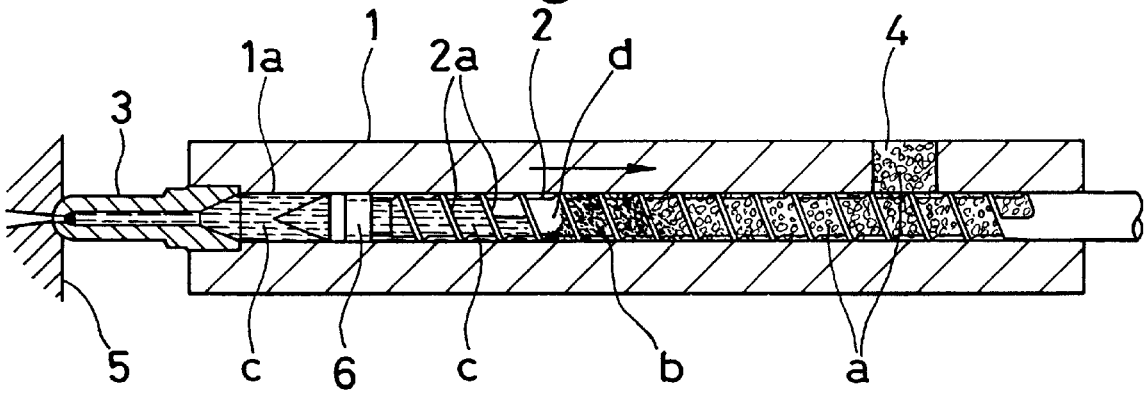
FIG. 2 is a schematic explanatory view showing a screw when it is forced to retract to a set position.

FIG. 2 is a view schematically showing a case where the screw 2 is forced to retract to a set position while maintaining the nozzle touch. The screw 2 is forced to retract from the forward position by being pulled backward by means of a hydraulic pressure or a driving device driven on electricity. Alternatively, the screw 2 may be forced to retract by being rotated slowly at a rotation rate distinguished from a rotation rate at the forward position. In this case, the material is transferred by means of rotation of the screw 2. Also, this prevents air bubbles from being contained in the material due to a negative pressure or a vacuum state from being produced during the retraction of the screw 2.

By this forced retraction, the liquid phase material c that has been stored primarily on the periphery of the head portion of the screw 2 pushes open the closed ring valve 6, and flows into a front chamber 1*a* formed ahead of the screw 2 within the heating cylinder 1. Consequently, a predetermined quantity of the molten metal material is accumulated (metered) in the front chamber 1*a*.

Figure 3:
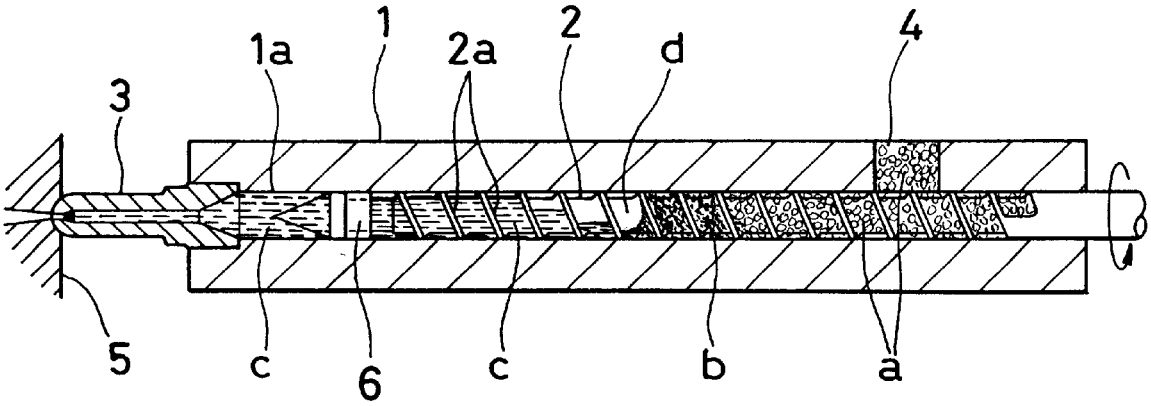
FIG. 3 is a schematic explanatory view showing the screw at the retraction position.

FIG. 3 is a view schematically showing a state where the metal material is metered by means of rotation of the screw 2 at the retraction position. At this point, when a back pressure is applied to the screw 2 rotating at the retraction position, the granular material a supplied from the supply port 4 at the rear portion of the screw 2 is introduced successively along the screw 2 and transferred toward the head of the heating cylinder 1 by means of rotation of the screw 2. On the way to the head, the granular material a starts to melt by heating from the external and turns into the semi-molten material b in a mixed state having both the solid phase and liquid phase.

When the liquid phase ratio in the semi-molten material b increases, only the liquid phase material c having a viscosity as low as that of hot water is readily collected below the screw 2 due to self-weight. However, the liquid phase material c is stored primarily on the periphery at the head portion of the screw 2 by a transfer effect realized by means of rotation of the screw 2. If the liquid phase material c accumulated in the front chamber 1*a* is short, the shortage is compensated.

The screw 2 is kept rotated for a predetermined time, and stopped when the liquid phase material c is accumulated in the front chamber 1*a*. Then, the screw 2 is moved forward at set rate and pressure. By this forward movement, a pressure is applied to the liquid phase material c accumulated in the front chamber 1*a*, and before the material pressure starts to rise, air or the like present at the upper portion of the front chamber 1*a* escapes toward the screw 2 through a space in the ring valve 6, whereby deaeration is conducted. Then, the ring valve 6 is closed by the material pressure.

After the ring valve 6 is closed, the material pressure rises further. When the material pressure reaches a set pressure within a preset forward distance of the screw 2, it is assumed that a set quantity of the metal material has been metered, whereupon the screw 2 is switched to a standby state and remains in that state until the next injection. In some cases, the screw 2 maybe retracted to conduct decompression before the injection, after which the screw 2 is switched to the standby state and remains in that state until the next injection.

If the material pressure fails to reach the set pressure after the screw 2 moves over the preset forward distance, it is assumed that there is a shortage in the metered quantity, whereupon the forward movement of the screw 2 is stopped. Then, the step is switched back to the metering step, and the foregoing steps are repeated sequentially. The metering is completed when confirmed by means of another forward movement of the screw 2.

Figure 4:
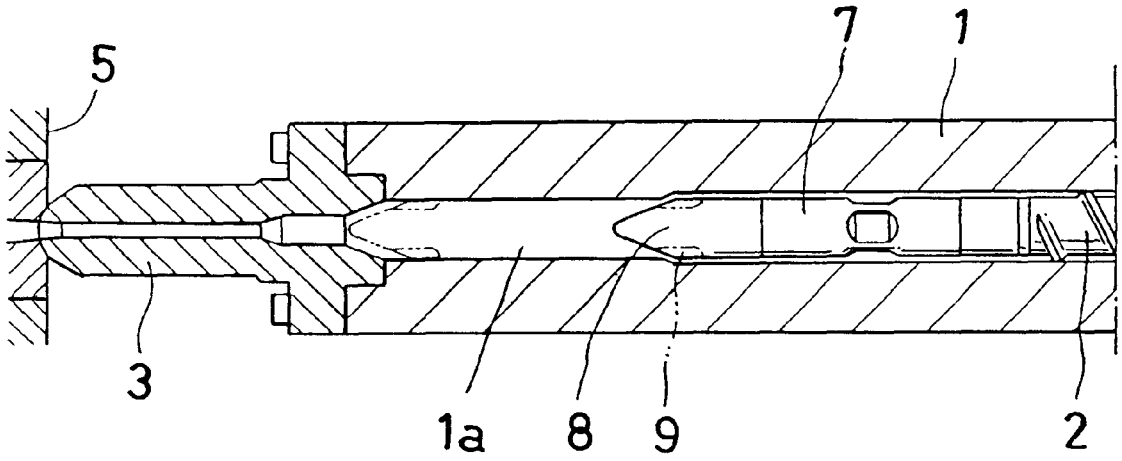
FIG. 4 is a longitudinal section of a top end portion of an injection apparatus equipped with a screw omitting a ring valve in accordance with another embodiment of the present invention.

FIG. 4 shows another embodiment of an injection apparatus equipped with a screw 2 omitting the ring valve 6 and including instead an injecting plunger at the tip thereof.

In a heating cylinder 1 of this injection apparatus, a front chamber 1*a* for metering is formed by reducing the inner diameter of the top end portion for a required length by 8 to 15% with respect to the inner diameter of the heating cylinder 1. It should be appreciated that the heating cylinder 1 includes a nozzle 3 at the tip in the same manner as the above embodiment.

The screw 2, which is housed in the heating cylinder 1 and allowed to rotate and move along the axial direction, is equipped with an injecting plunger 7 at the tip thereof. The diameter of the plunger 7 is substantially the same as the diameter of the front chamber 1*a*. According to this arrangement, the plunger 7 is allowed to fit into the front chamber 1*a* by moving forward and backward while securing a sliding clearance such that hardly causes a back flow of the liquid phase material c accumulated in the front chamber 1*a* of FIG. 3.

Also, a top end portion 8 of the plunger 7 is shaped in a cone with a tapered surface so as to fit into a funnel shape of the top end portion of the front chamber 1*a*. A plurality of concave channel grooves 9 are provided at regular intervals across the tapered surface and the head portion of the axis portion. The channel grooves 9 are not essential, and can be omitted if the retraction position of the screw 2 is set behind the one illustrated in the drawing and a channel space is formed on the periphery of the top end portion 8.

The screw 2 moves forward in the front chamber 1*a* until the top end portion 8 of the plunger 7 reaches the filling completion position by means of process control, and a full quantity of the liquid phase material c metered in the front chamber 1*a*, except for a required amount of the liquid phase material c used as a cushion, is injected into a mold 5.

The metering of the material after the injection is conducted in the same manner as the above embodiment. That is, the metal material in the clearance is removed by rotating the screw 2 before the retraction, after which the screw 2 is forced to retract for a set distance.

Because the tip of the nozzle 3 is clogged with the cooled and solidified material used for the preceding injection, the forced retraction of the screw 2 produces a negative pressure state (decompressed or vacuum state) in the front chamber 1*a* of the heating cylinder 1. Hence, the liquid phase material c stored primarily on the periphery of the head portion of the screw 2 flows into the front chamber 1*a* by means of suction and is accumulated therein. The steps thereafter are the same as those in the above embodiment explained with reference to FIG. 3, and the detailed description of these steps is omitted for ease of explanation.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An injection molding method of a metal material adapted to employ an injection apparatus comprising a heating cylinder provided with a nozzle at a tip thereof and a supply port at a rear portion thereof and having inside a screw, which is allowed to rotate and move along an axial direction, for injecting the metered metal material in a liquid phase state through said nozzle by moving said screw forward, said method comprising the steps of:

after injection, rotating said screw at a forward position a set number of times, removing metal material accumulated in a clearance between said heating cylinder and the screw flights wherein a retraction resistance is removed;

accumulating the metal material in the liquid phase state in a front chamber by forcing said screw to retract for a set distance with rotation of said screw stopped or at a slower rotation rate than a rotation rate in the forward position, and applying a back pressure to said screw rotating at a retraction position, thereby starting transfer of liquefied metal material;

completing accumulation by stopping rotation of said screw;

pressing the liquefied metal material accumulated by moving said screw forward; and effecting injection of the liquid phase metal material only when a material pressure reaches a set pressure within a preset forward distance of said screw, whereupon metering is assumed to have been completed.

2. The injection molding method of a metal material according to claim 1, wherein:

said screw includes an injecting plunger at the tip; and said plunger has substantially a same diameter as a diameter of the front chamber formed in said heating cylinder at a top end portion by reducing a diameter thereof so as to be allowed to fit into the front chamber by moving forward and backward while securing a sliding clearance that does not cause a back flow of the metal material in the liquid phase state accumulated in said front chamber.

* * * * *